United States Patent [19]

Scheerhorn

[11] 4,057,307

[45] Nov. 8, 1977

[54] LOCKING SYSTEM LINKAGE ADJUSTMENT

[75] Inventor: Douglas Scheerhorn, Grand Rapids, Mich.

[73] Assignee: Steelcase Inc., Grand Rapids, Mich.

[21] Appl. No.: 707,860

[22] Filed: July 22, 1976

[51] Int. Cl.[2] ..... E05B 65/46

[52] U.S. Cl. ..... 312/219

[58] Field of Search ..... 312/107.5, 215, 216, 312/217, 218, 219, 220, 221

[56] References Cited

U.S. PATENT DOCUMENTS

| | | | |
|---|---|---|---|
| 410,378 | 9/1889 | Rodeheaver | 312/219 |
| 2,930,666 | 3/1960 | Ibel | 312/218 |
| 3,318,646 | 5/1967 | Ibel | 312/218 |
| 3,857,621 | 12/1974 | Sheerhorn | 312/219 |

FOREIGN PATENT DOCUMENTS

| | | | |
|---|---|---|---|
| 1,042,422 | 10/1958 | Germany | 312/219 |

*Primary Examiner*—Paul R. Gilliam
*Assistant Examiner*—David H. Corbin
*Attorney, Agent, or Firm*—Price, Heneveld, Huizenga & Cooper

[57] ABSTRACT

The specification discloses a locking system for locking a plurality of drawers or like components in desk pedestals or like components having a primary and secondary locking means movable between a first position unlocking said components and a second position locking said components, and an adjustable linkage operably connecting the primary locking means to the secondary locking means. The linkage system includes two rods adjustably connected to each other by a spring clip whereby the effective length of the linkage assembly can be varied and the first and second positions of the secondary locking means thereby adjusted. The spring clip engages a linkage rod so there is a bias force against the linkage rod preventing movement of the rod relative to the spring clip.

13 Claims, 8 Drawing Figures

LOCKING SYSTEM LINKAGE ADJUSTMENT

BACKGROUND OF THE INVENTION

This invention relates to a locking system for desks, cabinets or other articles of furniture. More particularly, it relates to an adjustable linkage system connecting a primary and a secondary locking means for simultaneously locking and unlocking a plurality of drawers. Such mechanisms are also used as locks for doors located in pedestals or the like. The term primary locking means refers to the mechanism which is directly operated by a key lock and which therefore is the prime mover of the overall locking system. The term secondary locking means refers to the mechanism which actually locks the door or drawers to be locked. Some systems are designed so that one or more secondary means can be connected by separate linkage means to a single, primary locking means. By multiplying secondary means, one can use the same basic system for one or two pedestal desks, three or four compartment credenzas, and so on.

One problem encountered in such locking systems is that of adjustment of the linkage assembly to insure proper coordination between the primary and secondary locking means. One type of linkage assembly system used in the prior art to connect primary and secondary locking means includes an actuator rod having a U-shaped deviation therein which is made of a material which can readily be bent through the use of a pliers or other comparable implement. Thus, one can increase or shorten the length of the linkage rod by changing the bend in the deviation. More specifically, by pinching the legs of the U-shaped deviation inwardly towards one another, one can shorten the effective length of the linkage rod. Contrawise, one can increase the effective length of the linkage rod by prying the legs of the U-shaped deviation away from one another. Pliers can be used for the pinching and for the spreading or a screwdriver might be useable for the spreading. The U-shaped deviation is carried by a bracket for support. The bracket has an opening to provide acess to the U-shaped deviation. Thus, the use of tools is required and adjustment is limited to size of the U-shaped deviation.

SUMMARY OF THE INVENTION

In the present invention the actuator linkage rod is coupled to a secondary locking means and is adjustably joined to a moveable member of primary locking means by an adjustable spring clip. The spring clip couples transmission of movement from the primary locking means to the secondary locking means. By moving the spring clip along the moveable member, the effective length of the linkage rod is readily adjusted.

The use of a spring clip in accordance with this invention is advantageous because of increased simplicity and greater flexibility at fabrication, installation and operation. First, the use of tools is eliminated and the adjustment of the spring clip to change the effective length of the linkage can be accomplished manually. Second, a greater latitude of adjustability is provided. That is, adjustment of the spring clip is not limited as is the size of the U-shaped deviation. Third, adjustment can be made more precisely by relative movement of the spring clip and the linkage. The deformation of a U-shaped deviation results in some return to the original configuration of the deviation because of the resiliency of the material. Compensation by deforming more than is actually required is difficult to judge.

DETAILED DESCRIPTION

Figure 3:
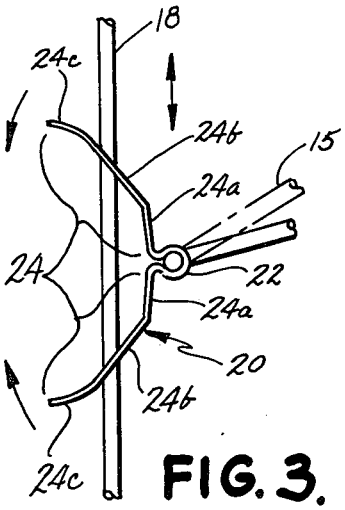
FIG. 3 is a top plan view of the spring clip joining the linkage to the primary lock system.
Figure 5:
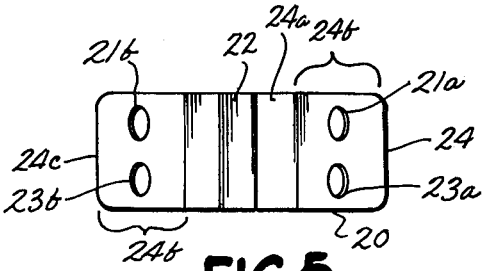
FIG. 5 is a front elevation view of a spring clip in accordance with the embodiment of this invention.

Referring to the drawings (FIG. 1), a locking system 20 has a primary locking system 17 coupled to a secondary locking system 11 in each desk pedestal 2 by an actuator linkage rod 15. Primary locking system 17 includes moveable rods 18 or as sometimes referred to herein, lock rods 18, to which linkage rods 15 are connected by spring clips 20. Spring clip 20 is made of a flat, elongated resilient material and has a general semicircular or V-shape (FIG. 3). Spring clip 20 is bent to define a generally cylindrical portion 22 at the base of the "V," which serves as a means for securing spring clip 20 to linkage rod 15. Linkage rod 15 extends up into cylindrical portion 22 and is trapped and firmly held therein. However, during operation of locking system 10, linkage rod 15 rotates with respect to cylindrical portion 22.

Figure 4:
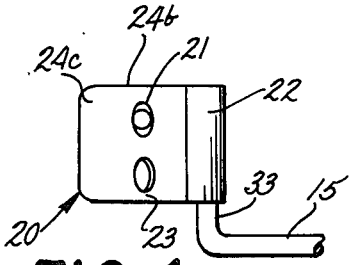
FIG. 4 is a side elevation view of the spring clip joining the linkage to the primary lock system.
Figure 8:
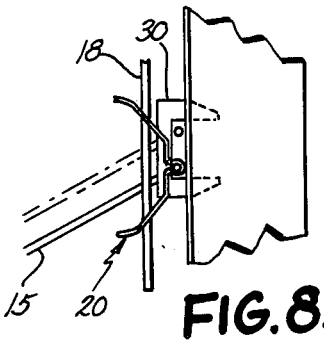
FIG. 8 is an enlarged view of inset VIII shown in FIG. 6.

A pair of legs 24 extend generally laterally and outward from cylindrical portion 22 and are bent to define three leg parts, **24*a*, 24*b* and 24*c* (FIG. 3). Portions 24*a* extend immediately from cylindrical portion 22, almost directly laterally, and serve as spacers to provide sufficient spread to legs 24 so spring clip 20 can be easily flexed. Portions 24*b* extend from portions 24*a*, generally diagonally across the path of locking rod 18. Finally end portions 24*c* are bent further inwardly towards one another from their junctions with portions 24*b*, almost extending perpendicular to rod 18 and parallel to one another. Portions 24*c* serve as thumb and finger grips for squeezing clip 20, as will be more fully explained herein below. A pair of opposed openings 21*a* and 21*b*, one in each diagonal portion 24*b* of leg 24 of spring clip 20 are aligned to engage lock rod 18 which is part of primary locking system 17. Openings 21*a* and 21*b* are formed slightly larger than the lateral cross sectional area of lock rod 18 (FIG. 4) so when legs 24 are pinched inward, toward each other, lock rod 18 can be moved through the holes. Holding the flanges in allows spring clip 20 to slide back and forth on lock rod 18 for infinite adjustment. When the flanges are released, spring clip 20 will lock in place along lock rod 18**.

Figure 1:
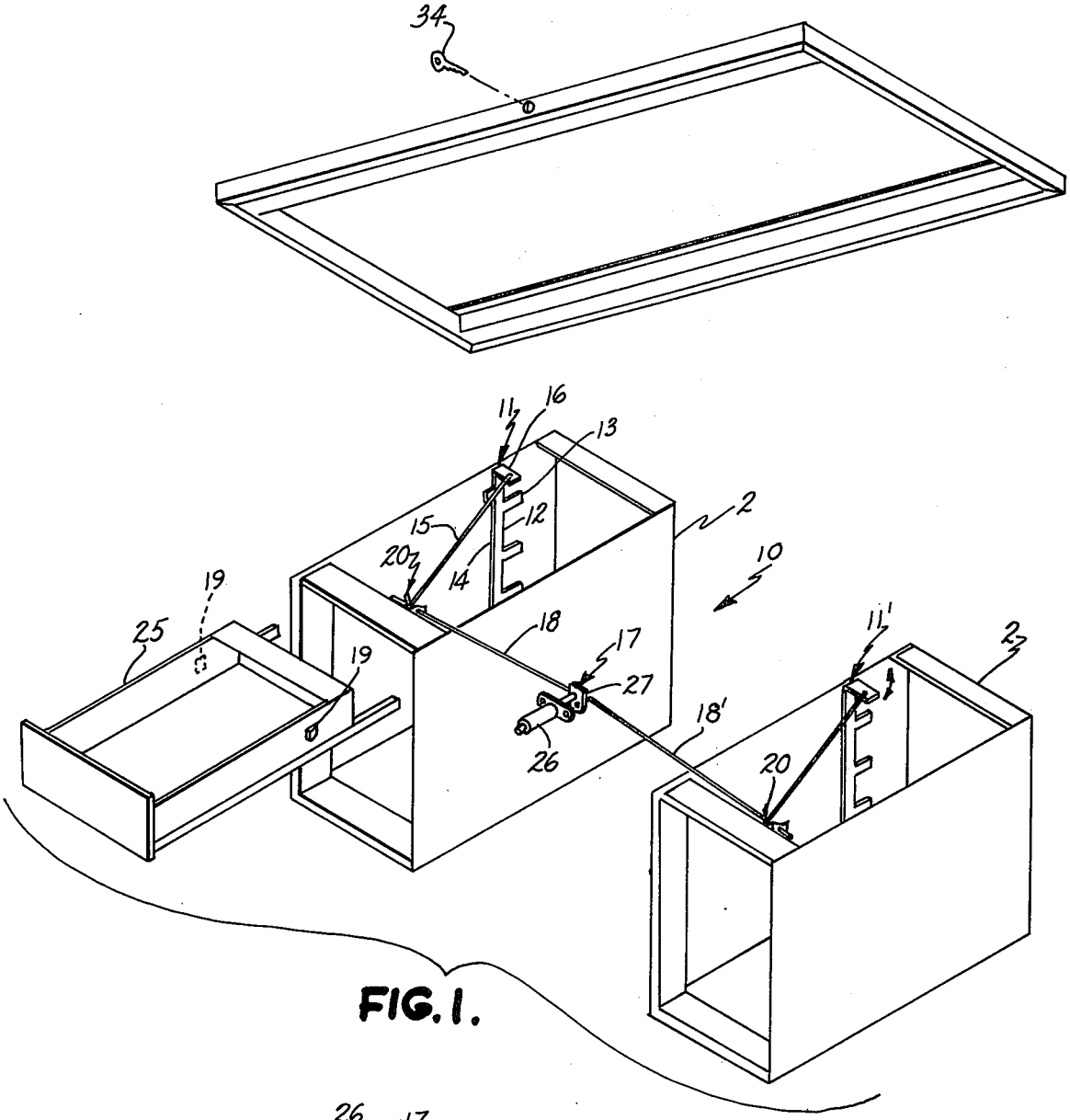
FIG. 1 is an exploded view of a pedestal desk and locking system in accordance with an embodiment of this invention.
Figure 2:
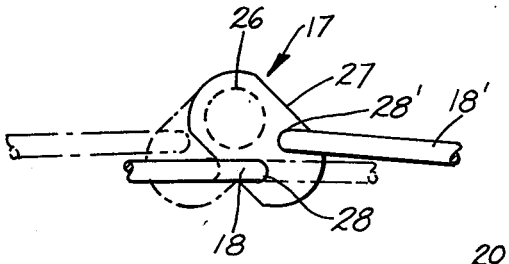
FIG. 2 is a front elevation view of the center lock of a locking system in accordance with an embodiment of this invention.
Figure 6:
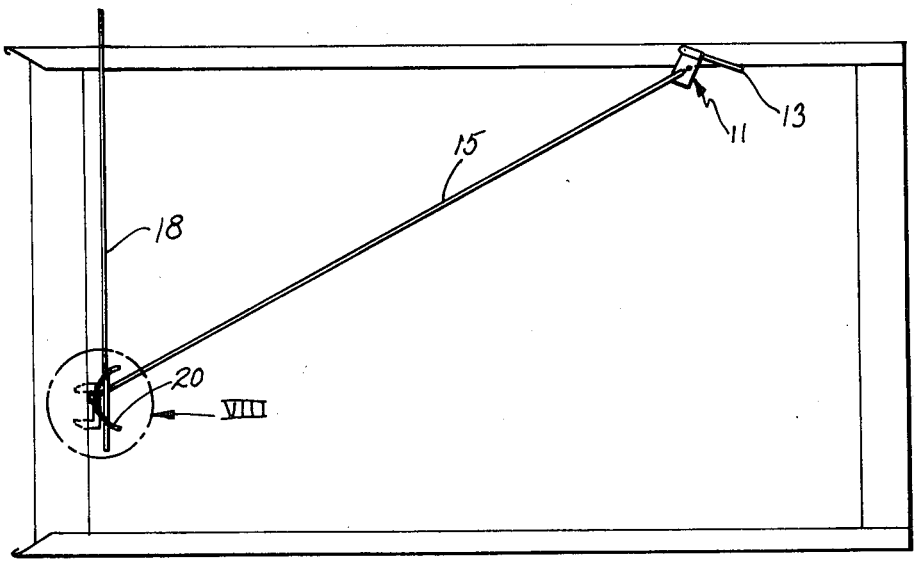
FIG. 6 is a top plan view of a locking system in accordance with the embodiment of this invention.

Secondary locking system 11 includes a vertical lock bar 12 having transversely extended lock tabs 13 for engaging lock catches 19 thereby preventing drawer 25 from being pulled out and angle flange 16 extending outwardly from vertical lock bar 12 and coupled to actuator linkage rod 15 to transmit a rotational motion to vertical lock bar 12 (FIGS. 1 and 6). Primary locking system 17 includes a lock cylinder 26 for receiving a key 34 and turning in cooperation with key 34 (FIGS. 1 and 2). Lock cylinder 26 is coupled to a lock cam 27 which has an opening 28 for receiving lock rod 18. Accordingly, rotational movement of key 34 is transmitted to longitudinal motion of lock rod 18. If desired, lock cam 27 can have additional openings (28') for connection to another lock rod (18') such as would be required when a single primary locking system controls two secondary locking systems in opposite directions. FIG. 1 shows such second primary locking systems (11 and 11') and a second lock rods (18 and 18').

Figure 7:
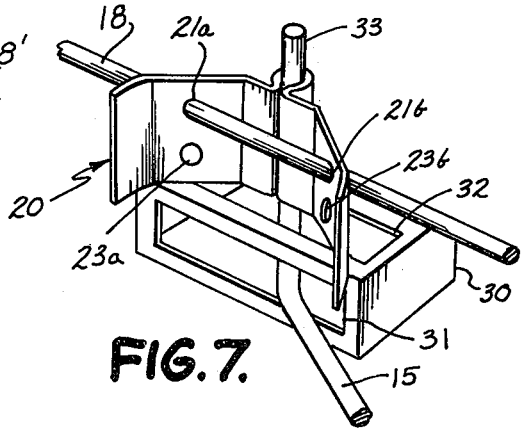
FIG. 7 is a front perspective view of the spring clip joining the linkage to the primary lock system.

Spring clip 20 is supported by a bracket 30 coupled to the component, such as a desk, to be locked (FIG. 7). Bracket 30 is generally a hollow rectangular box with an elongated opening 31 at the side for allowing entry of actuator linkage rod 15 and an elongated opening 32 in the top for allowing angled end 33 of actuator linkage rod 15 to protrude above bracket 30. Spring clip 20 is positioned so cylindrical area 22 is longitudinally aligned with angled end 33 and is spring biased toward it. Spring clip 20 is rotationally oriented so openings 21*a* and 21*b* are aligned to receive lock rod 18. Pressing the flanges of spring clip 20 toward each other brings openings 21*a* and 21*b* into position so lock rod 18 can easily pass. In an embodiment in accordance with this invention, spring clip 20 can have an additional pair of opposed openings 23*a* and 23*b*, one in each flange of spring clip 20 to accommodate any variations in the relative displacement of lock rod 18 from actuator linkage rod 15. Such displacement could occur when a single lock rod 18 is used to actuate a plurality of spaced actuator linkage rods 15. That is, lock rod 18 would have a gradual downward slope from lock cam 27. Although adjustment of spring clip 20 along angled end 33 of actuator linkage rod 15 is possible to accommodate for such differences, it is preferable to have the entire longitudinal length of cylindrical area 22 in contct with angled end 33.

OPERATION

One can lock drawer 25 by rotating vertical lock bar 12 so lock tabs 13 are moved into the path of lock catchers 19. Accordingly, a first position (unlocked) of lock tab 13 permits passage of lock catch 19 (FIG. 1) and a second (locked) position of lock tab 13 engages lock catches 19. In order to achieve proper adjustment of locking system 10, so that lock bar 12 does not lock drawer 25 when it is not supposed to and so that it is in a locking position when lock cylinder 26 has been rotated to a point where one can remove the key, one can simply adjust the effective length of actuator linkage rod 15 and lock rod 18. Advantageously, when the lock tabs 13 are in a lock position, lock rod 18 is adjusted for maximum travel through openings 21*a* and 21*b* of spring clip 20. If there are a plurality of spring clips 20 along the length of lock rod 18 then a similar adjustment is made for all spring clips 20. As a result of this adjustment, the effective length of the connection from lock rod 18 to secondary locking system 11 has been adjusted. During adjustment, spring clip 20 moves longitudinally with respect to lock rod 18 and permits rotational movement of angled end 33 of linkage rod 15 with respect to cylindrical portion 22. During movement for locking or unlocking, there is no relative movement between lock rod 18 and spring clip 20 but there is relative rotational movement between spring clip 20 and linkage rod 15.

Such an adjustment of a locking system 10 is typically necassary because of manufacturing tolerances in the fabrication of linkage rods, locking bars and locking mechanisms. Now such variations due to manufacturing tolerances can be accurately compensated for without the use of tools. Further, lock rod 18 can be made in several uniform lengths because minor variations can be compensated for by sliding spring clip 20 along lock rod 18. Such standardization is advantageous because it reduces cost. Further, the assembly and adjustment of the linkages has been accomplished without the use of any welding. A typical spring clip 20 is rolled and then has openings 21 and 23 punched. A typical material for spring clip 20 is spring steel. Secondary locking system 11 may also include an embodiment where a swinging credenza door is locked. Typically, for example, actuator linkage rod 15 is then coupled to a lever which swings to engage a hook coupled to a door.

Various modifications will no doubt occur to those skilled in the art to which this invention pertains. For example, the particular separation of the legs of the spring clip and the shape of the openings may be varied from that disclosed herein. These and all other variations which basically rely on the teachings by which this disclosure has advanced the art are properly considered within the scope of this invention.

The embodiments of the invention in which an exclusive property or privilege is claimed are defined as follows.

1. A locking system for locking the drawers, doors or like components of a desk pedestal or like compartment, said drawers, doors or like components including a lock stop, said locking system comprising;

a primary locking means having a first movable member selectively movable to a first locking position and to a second unlocking position;

a secondary locking means having a second movable member selectively moveable to a first locking position engaging said lock stop and to a second unlocking disengaging said lock stop position;

a spring clip;

a linkage member coupled to said first moveable member of said primary locking means by said spring clip and to said second moveable member of said secondary locking means for coupling movement between said first and second movable members; and said spring clip being releaseably coupled to one of said linkage member and said first moveable member and being coupled to the other thereof, said one of said linkage and first moveable members having sufficient length that said spring clip can be releaseably secured in a plurality of different positions along said length so that the position of said spring clip can be changed thereby changing the effective length of said linkage member and effecting adjustment between the relative positions and movements of said first and second movable members of said primary and secondary locking systems.

2. A locking system as recited in claim 1 wherein said first moveable member comprises an elongated moveable rod; said spring clip being releaseably coupled to said moveable rod along the length thereof.

3. A locking system as recited in claim 2 wherein said linkage comprises a linkage rod having an angled end;

said spring clip including a pair of legs, each leg having a hole for receiving said moveable rod, and a generally circular deviation intermediate said pair of legs for rotationally coupling to said angled end of said linkge rod, whereby movement of said moveable rod is transmitted to said spring clip and movement of said spring clip causes relative rotational movement between said spring clip and said angled end of said linkage rod.

4. A locking system as recited in claim 3 wherein each of said pair of legs of said spring clip comprises:

a first generally planar extension from said generally circular deviation, extending substantially perpendicularly to the longitudinal axis of said circular deviation and substantially parallel to said moveable rod;

a second generally planar extension from said first extension, extending diagonally across the path of said moveable rod, said second extension having edges around openings for releaseably engaging said moveable rod and preventing relative movement of said moveable rod and said spring clip; and a third generally planar extension from said second extension substantially more perpendicular to said moveable rod than said second extension thereby providing grips for squeezing said spring clip annd releasing engagement of said moveable rod.

5. A locking system for locking the drawers, doors or like components of a desk pedestal or like compartment, said drawers, doors or like components including a lock stop, said locking system comprising:

a lock bar means mounted in said compartment for pivotal movement between a first, unlocking position and a second, locking position; and means for pivoting said lock bar means between said first and second positions; said lock bar means projecting into the path of said lock stop on said components to thereby lock said components in said compartment when said lock bar means is pivoted to said second locking position; said lock bar means clearing the path of said lock stop of said compartments to thereby unlock said components in said compartment when said lock bar means is pivoted to said first unlocking position; said means for pivoting comprising an elongated actuator linkage rod being coupled to said lock bar means and to an adjustable spring clip which, in turn, is coupled to a primary locking system, including a moveable rod adjustably coupled to said spring clip, whereby the movement of said primary locking system is transmitted to said lock bar means; said moveable rod having a sufficient length that said spring clip can be releasably secured in a plurality of different positions along the length of said moveable rod so that the position of said spring clip can be changed thereby changing the effective length of said linkage rod and effecting adjustment between the relative positions and movements of said lock bar means and said means for pivoting said lock bar means between said first and second positions.

6. A locking system as recited in claim 5 wherein said spring clip rotationally engages said linkage rod and is biased against said moveable rod to prevent relative motion of said moveable rod with respect to said spring clip.

7. A locking system as recited in claim 6 further comprising a bracket mounted to said compartment for supporting said spring clip and for guiding a portion of said actuator linkage rod.

8. A locking system as recited in claim 7 wherein said means for pivoting said lock bar means includes:

a lock cylinder supported relative to said moveable rod; and a lock cam rotationally coupled to said lock cylinder and having engaging means joining said moveable rod to said lock cam thereby transmitting the motion of said lock cam to said moveable rod.

9. A locking system as recited in claim 8 wherein said spring clip includes a flat, elongated member having a generally semi-circular configuration, a deviation intermediate the ends of said member for engaging said actuator linkage rod and a pair of opposing openings through said spring clip positioned to pass said moveable rod when said spring clip is compressed inwardly and applying a biasing force to said locking rod when positioned in said openings and the inward compression is removed.

10. A locking system for locking the drawers, doors or like components of desk pedestal or like compartment, said locking system comprising:

a primary locking means moveable between first and second positions;

a secondary locking means moveable, in response to movement of said primary locking means to said first and second positions, between a first unlocking said components and a second position locking said components, respectively;

a spring clip;

a linkage rod operably connected to said spring clip and operably connected to said secondary locking means;

said primary locking means including a moveable rod adjustably coupled to said spring clip, whereby movement of said primary locking means is transferred to said secondary locking means and the effective length of said linkage and moveable rods can be varied and the first and second positions of said secondary locking means thereby adjusted, said spring clip exerting a biasing force on said moveable rod to prevent relative motion between said moveable rod and said spring clip.

11. The locking system of claim 10 wherein said linkage rod includes an angled end; and said spring clip includes a flat, elongated member having a generally curved configuration along the longitudinal axis of said elongated member, a deviation intermediate the ends of said member for rotationally engaging said angled end of said linkage rod and a pair of opposing openings through said spring clip positioned to pass said moveable rod when said spring clip is compressed inwardly and applying a biasing force to said moveable rod when positioned in said openings and said spring clip is not compressed inwardly.

12. The locking system as recited in claim 11 further comprising a bracket mounted to said compartment for supporting said spring clip and for guiding said linkage rod.

13. The locking system as recited in claim 12 further comprising a second pair of opposing openings in said spring clip, displaced from said pair of opposing openings transversely along said spring clip, for compensating for relative transverse displacement of said spring clip from said moveable rod.

* * * * *

UNITED STATES PATENT OFFICE

CERTIFICATE OF CORRECTION

Patent No. 4,057,307 Dated November 8, 1977

Inventor(s) Douglas Scheerhorn

It is certified that error appears in the above-identified patent and that said Letters Patent are hereby corrected as shown below:

Column 2, line 26:
"20" should be --10--
Column 3, line 41:
"contct" should be --contract--
Column 5, line 4:
"linkge" should be --linkage--
Column 4, line 68:
"said linkage comprises" should be --said linkage member comprises--
Column 5, line 23:
"extension substantially" should be --extension extending substantially--
Column 5, line 25:
"annd" should be --and--
Column 5, line 40 & 41:
"compartments" should be --components--
Column 6, line 28:
"first unlocking" should be --first position unlocking--

Signed and Sealed this

Second Day of May 1978

[SEAL]

Attest:

RUTH C. MASON
Attesting Officer

LUTRELLE F. PARKER
Acting Commissioner of Patents and Trademarks